US007159518B2

(12) United States Patent
Haas et al.

(10) Patent No.: US 7,159,518 B2
(45) Date of Patent: Jan. 9, 2007

(54) TEMPERING DEVICE FOR PRINTING PRESSES

(75) Inventors: Thomas Haas, Corona, CA (US); Nicholas Cruz, Yorba Linda, CA (US); Steve Barberi, Corona, CA (US); Lou J. Barberi, Perris, CA (US)

(73) Assignee: Technotrans AG, Sassenberg (DE)

( * ) Notice: Subject to any disclaimer, the term of this patent is extended or adjusted under 35 U.S.C. 154(b) by 121 days.

(21) Appl. No.: 10/991,086

(22) Filed: Nov. 17, 2004

(65) Prior Publication Data

US 2005/0150410 A1 Jul. 14, 2005

(30) Foreign Application Priority Data

Nov. 21, 2003 (DE) ..... 103 54 454

(51) Int. Cl.
*B41F 1/34* (2006.01)
*F25B 27/00* (2006.01)

(52) U.S. Cl. ..... 101/487; 101/480; 62/175; 62/515; 62/520

(58) Field of Classification Search ..... 101/487; 62/175, 515, 520; *B41F 1/34; F25B 27/00*
See application file for complete search history.

(56) References Cited

U.S. PATENT DOCUMENTS 5,657,637 A * 8/1997 Mertens ..... 62/175
5,720,221 A * 2/1998 Harig et al. ..... 101/148
5,893,411 A * 4/1999 Nir ..... 165/140
5,974,817 A * 11/1999 Prummer ..... 62/238.6
6,089,313 A * 7/2000 Levy et al. ..... 165/140
6,789,470 B1 * 9/2004 Luebcke ..... 101/38.1
2003/0029342 A1 * 2/2003 De Vroome ..... 101/487

FOREIGN PATENT DOCUMENTS

DE 297 16 582 12/1997

* cited by examiner

*Primary Examiner*—Judy Nguyen
*Assistant Examiner*—Matthew Marini
(74) *Attorney, Agent, or Firm*—Richard M. Goldberg

(57) ABSTRACT

A tempering device for printing presses, includes a compression refrigerating plant with a condenser and an evaporator, in which a coolant circulates in a compression refrigerating path, and a free cooling path, in which a coolant circulates. A process water path circulates a coolant for either printing rollers or a fountain solution for offset printing. A heat exchanger arrangement cools the process water path with the help of the compression refrigerating plant and/or the free cooling path. The heat exchanger arrangement includes a three-media heat exchanger, in which heat is exchanged between the process water path and the compression refrigerating plant as well as the free cooling path.

3 Claims, 1 Drawing Sheet

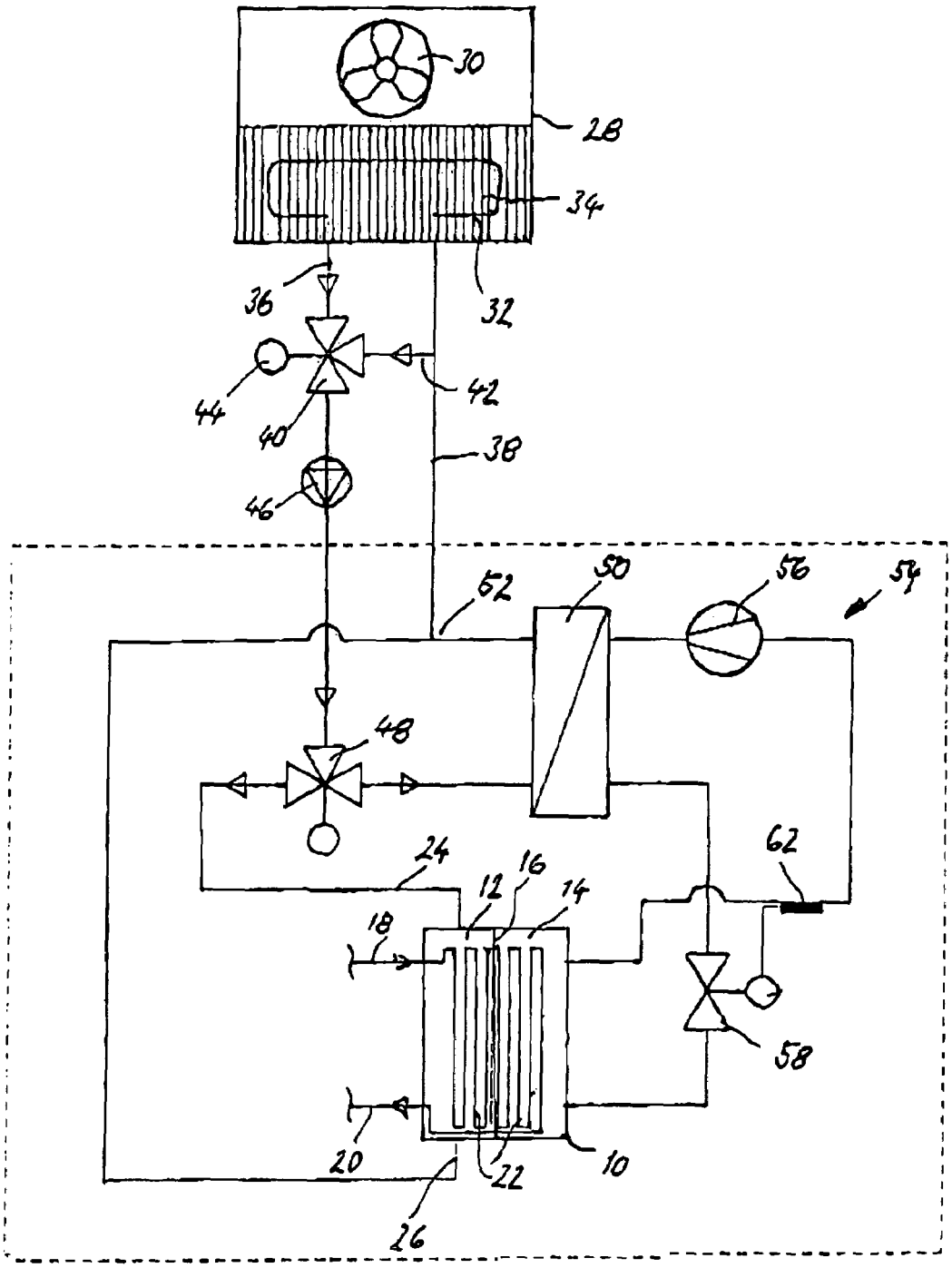
30
28
34
36
32
44
42
40
38
46
52
50
56
54
48
24
16
12
14
62
18
58
20
22
10
26

TEMPERING DEVICE FOR PRINTING PRESSES

BACKGROUND OF THE INVENTION

The invention relates to a tempering device for printing presses with compression refrigerating plant with a condenser and an evaporator, in which a coolant circulates, a free cooling circuit, in which a coolant, especially water, circulates, a process water cycle, in which a coolant for printing rollers or a fountain solution for offset printing circulates, and heat-exchanger means for cooling the cycling process water with the help of the compression refrigerating plant and/or of the free cooling cycle.

Various embodiments of tempering systems for printing presses are known. As a rule, they are cooling systems, since a certain amount of heating, which can affect the printing quality, necessarily occurs during the operation of the printing press. The cooling can take place by water cooling of the friction rollers with the help of a pipeline system passing through these rollers or, in the case of offset printing, by means of a cooled fountain solution, which is applied on the rollers. Occasionally, cool air is also blown on certain parts or components of the printing presses.

Refrigeration plants, which have relatively high energy consumption, are required for these systems. Systems, which are cooled directly or indirectly by refrigeration plants, that is, compression refrigerating plants, are known. In most cases, directly cooled systems function by cooling the process medium, in most cases water or a mixture of water and glycol, directly by an evaporating coolant in the evaporator of a compression refrigerating plant, constructed as a heat exchanger. Directly cooled systems either have an integrated air-cooled or water-cooled condenser or an external air-cooled condenser.

Indirectly cooled systems generally are cooled by water. In these systems, the process water is cooled in an integrated water/water heat exchanger by the cooling water of an external source. In some cases, the process water is also cooled by mixing it with the cooling water of the external source. Since a separation of the cycles necessarily is impossible, this method is not suitable for cooling fountain solution.

Directly cooled systems, with a water-cooled condenser in the cooling cycle, obtain their cooling water usually from central cooling water systems. These frequently are systems with free coolers or evaporative coolers. The temperature level of the cooling water of these external cooling systems is always low enough, in order to ensure adequate cooling of the water-cooled condenser of the cooling plant. Likewise, the temperature level in most cases is sufficient for supplying other peripheral equipment at printing presses, such as air-supplying cabinets or drying cabinets, adequately with cooling. However, since the temperature level of this cooling water is not always low enough, so that this cooling water can be used by means of a water/water heat exchanger for cooling the process water directly for cooling the friction rollers in the printing press, such systems are not being used at the present time.

The conventional systems have the disadvantage, in particular, that they use much energy and, correspondingly, have high operating costs.

SUMMARY OF THE INVENTION

It is therefore an object of the invention to provide cooling equipment for printing presses, which can make do with the use of considerable less energy and make possible an effective tempering of different tempering media, without any mixing of the cooling water and the tempering water.

This objective is accomplished by tempering equipment of the above type, owing to the fact that a three-media heat exchanger is provided, in which the cycling process water can undergo heat exchange with the compression refrigerating cycle as well as with the free cooling cycle.

A three-media heat exchanger is understood to be a heat exchanger, through which the compression refrigerating cycle and the free cooling cycle flow in separate chambers, while the process water cycle or the tempering medium cycle passes through both chambers in a separate pipeline system.

In this connection, it does not matter whether the two chambers of the three-media heat exchanger form a spatial unit and have a common housing with a partition, or whether they represent separate units.

With a three-media heat exchanger of the type mentioned, it is possible, if the outside temperature is sufficiently low, to cool only with the help of the free cooling cycle. On the other hand, when the outside temperatures are high, the compression refrigerating cycle is used additionally or alone for cooling the process water.

The cycle, referred to as a free cooling cycle, may have, for example, a water cooler, through which outside air flows with the help of a blower. This cycle may also, however, be a different source, which provides relatively cool water.

The free cooling cycle can pass through the condenser-heat exchanger of the compression refrigerating plant parallel to the three-media heat exchanger and be used to condense the coolant circulating in the compression refrigerating cycle.

The chamber of the three-media heat exchanger, through which the compression refrigerating cycle flows, preferably forms the evaporator of the compression refrigerating cycle.

A tempering device of the type described requires, for example, no additional cooling by the compression refrigerating plant as long as the surrounding temperature of the air, which is used for cooling the cooling water, or also the temperature of a different source of cooling water has a value sufficiently below the temperature of the process water. If the temperature of the cooling water is too high for cooling the process water strictly directly, the flow of cooling water is divided. In this case, it can either pre-cool the process water to a certain degree, as long as the temperature of the cooling water is below the temperature of the process water, or cool the water-cooled condenser-evaporator of the compression refrigerating plant, which must also be connected now in the circuit.

If the temperature of the cooling water of the free cooling cycle itself is too high for pre-cooling the process water, the free-cooling cycle itself can only be used for cooling the condenser-evaporator of the compression refrigerating plant.

Preferably, the process water initially passes through that chamber of the two chambers of the three-media heat exchanger, through which the cooling water of the free cooler cycle is flowing, so that the pre-cooling effect mentioned can be utilized, if the temperature conditions are suitable.

It is a particular advantage of the inventive solution that the process water exchanges heat in the heat exchanger not only with the compression refrigerating cycle but also with the free cooling cycle. In other words, that the free cooling cycle is not used directly as a process water cycle. In this way, different media can be circulated in the individual cycles. For example, the process water cycle can be formed by a fountain solution for the offset printing, whereas the free cooling cycle contains water, for example, also water with an anti-freeze agent. Each cycle may have a pipeline system of materials, which are particularly suitable for transporting the medium, such as a stainless steel in the case of corrosive media.

BRIEF DESCRIPTION OF THE DRAWINGS

In the following, preferred examples of the invention are explained in greater detail by means of the attached drawing.

The single FIGURE shows a possible example of the invention.

DETAILED DESCRIPTION

In the drawing, a three-media heat exchanger is labeled 10. This three-media heat exchanger 10 has a first chamber 12 and a second chamber 14, which, in the case of the embodiment shown, are combined into a spatial unit within a common housing and are separated only by a partition 16. The two chambers may, however, also form separate entities. An inlet pipeline 18 of a process water cycle enters the first chamber 12. On the other hand, an outlet pipeline 20 of this process water cycle leaves this chamber 12. The two pipelines 18, 20 are connected in the interior of the two chambers with coiled pipes 22, in which the process water flows through the two chambers 12, 14.

The inlet pipeline 18 and the outlet pipeline 20 are connected outside of the three-media heat exchanger with a printing press, which is not shown.

The inlet 24 and outlet 26 of a free cooling cycle, which has a water-air radiator with a fan 30 as cooling source, are connected with the first chamber 12 of the three-media heat exchanger 10, which has a water-air radiator 28 with a fan as cooling source, and are shown in the left section of the drawing. A coiled pipe 32, on which parallel sheet metal plates 34, by means of which the heat transfer surface of the pipe is enlarged, are fastened at a distance from one another, passes through the water-air radiator 28.

Outside of the water-air radiator 28, the coiled pipe changes over into an advance pipeline 36 of a free cooling cycle, the return pipeline 38 of which, on the other hand, enters the water-air radiator 28 and is connected with the coiled pipe 32.

In the further course, the advance pipeline 36 contains a three-way valve 40, into which, at the same time, a bypass pipeline 42, coming from the return pipeline 38, enters. With the help of the three-way valve 40, which has a servo 44 motor 44 and can be controlled as a function of the advance pipeline temperature with the help of an electronic control system, a portion of the cooling water can be supplied directly from the return pipeline 38 into the advance pipeline if, for example, the cooling water, cooled in the water-air radiator 28, is too cold for the purpose for which it is required.

Downstream from the three-way valve 40, there is a pump 46, adjoining which there is a three-way valve 48 with a servo motor.

From this three-way valve 48, the cooling water can be passed, depending on the setting of the valve, on the one hand to the left in the drawing to the inlet 24 of the left chamber 12 of the three-media heat exchanger 10. On the other hand, the cooling water also can flow to the right to a condenser-heat exchanger of a compression refrigerating plant, which will be described below. The outlet 26 of the left chamber 12 of the three-media heat exchanger 10 and an outlet (not labeled) of the condenser-heat exchanger 50 are combined into the return pipeline 38 at a point 52.

The three-way valve 48 can be controlled so that, depending on the mode of operation that is desired, the cooling water can be distributed completely or partly to the one side or the other. If the temperature in the free cooling cycle is sufficiently low, the process water cycle in the left chamber 12 of the three-media heat exchanger 10 alone can be cooled.

However, this will not be possible when the outside temperatures are high and, with that, the temperature of the cooling water is too high. In these cases, a compression refrigerating cycle 54 must therefore be inserted.

This compression refrigerating cycle 54 comprises a compressor 56, the already mentioned condenser-heat exchanger 50, an expansion valve 58 and an evaporator, which is formed by the second chamber 14 of the three-media heat exchanger. The four elements mentioned are connected with one another in a closed cycle, as is customary with refrigerators. A temperature sensor 62 determines the temperature in the pipeline between the evaporator 14 and the compressor 56 and emits signals, which are used to control the expansion valve 58.

The mode of action of the inventive tempering device is to be described below. When a water-air radiator of the type shown is used, it will depend primarily on the outside temperature whether the cooling of the printing press can be achieved only with the help of the cooling water of the free cooling cycle or whether a compression refrigerating cycle must be inserted. If the outside temperature is sufficiently low, only the cooling water cycle has to be used for the cooling by opening the three-way valve 48 to the left, so that the cooling water flows in a closed cycle through the left chamber 12 of the three-media heat exchanger 10. If the temperature is too low, already heated cooling water from the return pipeline 38 can be mixed over the three-way valve 40 with the water in the advance pipeline.

If the external temperature increases and the cooling effect of the free cooling cycle is no longer sufficient, the free cooling cycle can still be used under some circumstances for cooling the process water.

For this reason, the process water initially passes through the left chamber 12 in the drawing, in which heat exchange with the cooling water of the free cooling cycle takes place, and subsequently through the chamber 14, which is formed by the evaporator of the compression refrigerating cycle.

If the cooling water of the free refrigerating cycle is also no longer suitable for pre—cooling the process water, it can still be used at least in the condenser-heat exchanger 50 of the compression cooling cycle, which now alone cools the process water by way of the right chamber 14 of the three-media heat exchanger.

The invention claimed is:

1. Tempering device for printing presses, comprising;

a compression refrigerating plant with a condenser and an evaporator, in which a coolant circulates in a compression refrigerating path, a free cooling path, in which a coolant circulates, a process water path, in which a coolant circulates for one of:

printing rollers, and a fountain solution for offset printing and a heat exchanger arrangement for cooling the process water path with the help of at least one of:

the compression refrigerating plant and the free cooling path, the heat exchanger arrangement including a three-media heat exchanger, in which heat is exchanged between the process water path and the compression refrigerating plant as well as the free cooling path, wherein the three-media heat exchanger has two separate chambers including, on the one hand, a chamber through which the compression refrigerating path flows and which forms the evaporator of the compressor refrigerating plant, and on the other hand, a chamber through which the free cooling path flows, and the process water path passes through both chambers in separate pipe-line systems.

2. The tempering device of claim 1 wherein the process water path initially passes through the chamber which is connected with the free cooling path, and then through the chamber which is formed by the evaporator of the compression refrigerating plant.

3. The tempering device of claim 1, wherein the free cooling path passes through the condenser-heat exchanger of the compression refrigerating plant parallel to the three-media heat exchanger.

* * * * *